US008674906B2

(12) United States Patent
Hwang et al.

(10) Patent No.: US 8,674,906 B2
(45) Date of Patent: Mar. 18, 2014

(54) ORGANIC LIGHT EMITTING DISPLAY DEVICE

(75) Inventors: Young-In Hwang, Yongin (KR); Yong-Sung Park, Yongin (KR); Chul-Kyu Kang, Yongin (KR); Seong-Il Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 350 days.

(21) Appl. No.: 12/987,987

(22) Filed: Jan. 10, 2011

(65) Prior Publication Data

US 2012/0019499 A1 Jan. 26, 2012

(30) Foreign Application Priority Data

Jul. 20, 2010 (KR) ..... 10-2010-0069938

(51) Int. Cl.
*G09G 3/30* (2006.01)

(52) U.S. Cl.
USPC ..... 345/76; 345/211; 345/213; 345/82; 345/204; 315/169.1; 315/169.2; 315/169.3; 315/169.4; 313/500

(58) Field of Classification Search
USPC ..... 345/213, 211, 76, 82, 204; 315/169.1–169.4; 313/500
See application file for complete search history.

(56) References Cited

U.S. PATENT DOCUMENTS

2009/0237123 A1* 9/2009 Jinta ..... 327/108
2010/0309187 A1* 12/2010 Kang et al. ..... 345/211
2011/0018858 A1* 1/2011 Ryu et al. ..... 345/213

FOREIGN PATENT DOCUMENTS

KR 1020070083072 A 8/2007

* cited by examiner

*Primary Examiner* — Abbas Abdulselam
*Assistant Examiner* — Shawna Stepp Jones
(74) *Attorney, Agent, or Firm* — Christie, Parker & Hale, LLP

(57) ABSTRACT

An organic light emitting display device operates for an initializing period, a scan period and an emission period divided from one frame period. The organic light emitting display device includes: a data driver for supplying data signals to output lines; a connecting unit for selectively coupling a data line of data lines to a corresponding one of the output lines or an initial power supply, and being positioned between the output lines and the data lines; a second power driver for applying second power having a low level and a high level to pixels positioned at crossing regions of scan lines and the data lines; and a first control line commonly coupled to the pixels, in which each of the pixels includes an organic light emitting diode, and an anode electrode of the organic light emitting diode is supplied with a voltage of the initial power supply for the initializing period.

19 Claims, 10 Drawing Sheets

ORGANIC LIGHT EMITTING DISPLAY DEVICE

CROSS-REFERENCE TO RELATED APPLICATION

This application claims priority to and the benefit of Korean Patent Application No. 10-2010-0069938, filed on Jul. 20, 2010, in the Korean Intellectual Property Office, the entire content of which is incorporated herein by reference.

BACKGROUND

1. Field

Aspects of embodiments according to the present invention relate to an organic light emitting display device.

2. Description of the Related Art

Recently, flat panel display devices having reduced weight and volume in comparison to a cathode ray tube are being developed. The flat panel display devices include liquid crystal displays, field emission displays, plasma display panels and organic light emitting display devices, and the like.

The organic light emitting display device displays an image using organic light emitting diodes that produce light by recombining electrons and holes. The organic light emitting display device has the advantage that it has fast response speed and is driven at low power.

FIG. 1 is a circuit diagram illustrating a pixel of an organic light emitting display device in the related art.

Referring to FIG. 1, a pixel 4 of an organic light emitting display device of the related art includes: an organic light emitting diode OLED; and a pixel circuit 2 coupled with a data line Dm and a scan line Sn for controlling the organic light emitting diode OLED.

The anode electrode of the organic light emitting diode OLED is coupled to the pixel circuit 2, and the cathode electrode is coupled to a second power supply ELVSS. The organic light emitting diode OLED produces light with predetermined luminance in response to the current supplied from the pixel circuit 2.

The pixel circuit 2 controls the amount of current supplied to the organic light emitting diode OLED, in response to a data signal supplied to the data line Dm, when a scan signal is supplied to the scan line Sn. For this configuration, the pixel circuit 2 includes: a second transistor M2 coupled between a first power supply ELVDD and the organic light emitting diode OLED; a first transistor M1 coupled to the second transistor M2, the data line Dm, and the scan line Sn; and a storage capacitor Cst coupled between a gate electrode and a first electrode of the second transistor M2.

A gate electrode of the first transistor M1 is coupled to the scan line Sn, and a first electrode of the first transistor M1 is coupled to the data line Dm. Further, a second electrode of the first transistor M1 is coupled to one terminal of the storage capacitor Cst. In this configuration, the first electrode is any one of a source electrode and a drain electrode, and the second electrode is the other electrode different from the first electrode. For example, when the first electrode is the source electrode, the second electrode is the drain electrode. The first transistor M1 coupled to the scan line Sn and the data line Dm is turned on and supplies a data signal, which is supplied through the data line Dm, to the storage capacitor Cst. In this operation, the storage capacitor Cst is charged with a voltage corresponding to the data signal.

The gate electrode of the second transistor M2 is coupled to one terminal of the storage capacitor Cst, and the first electrode of the second transistor M2 is coupled to the first power supply ELVDD and the other terminal of the storage capacitor Cst. Further, the second electrode of the second transistor M2 is coupled to the anode electrode of the organic light emitting diode OLED. The second transistor M2 controls the amount of current flowing from the first power supply ELVDD to the second power supply ELVSS through the organic light emitting diode OLED, in response to the voltage value stored in the storage capacitor Cst. In the configuration of FIG. 1, the organic light emitting diode OLED emits light corresponding to the amount of current supplied from the second transistor M2.

However, the pixel 4 of the organic light emitting display device of the related art cannot display an image with uniform luminance. To be more specific, the second transistors M2 (driving transistor) in the pixels 4 may have different threshold voltages for each pixel 4 due to process variation. As the threshold voltages of the driving transistors are different, light with different luminance is generated by the pixels due to the difference in the threshold voltages of the driving transistors, even if data signals corresponding to the same gradation are supplied to the pixels 4.

In order to overcome the problems, a structure including an additional transistor is formed in each pixel 4 to compensate for the threshold voltage of the driving transistor. A structure for compensating for the threshold voltage of a driving transistor using six transistors and one capacitor for each pixel 4 has been disclosed. However, the six transistors in the pixel 4 complicate the pixel 4. In particular, the possibility of malfunction is increased and yield is correspondingly decreased by the increased number of transistors in the pixels.

SUMMARY

Aspects of embodiments according to the present invention are directed toward an organic light emitting display device having a simple structure and being capable of compensating for the threshold voltage of a driving transistor.

According to one embodiment of the present invention, there is provided an organic light emitting display device that is configured to operate for an initializing period, a scan period and an emission period divided from one frame period, the organic light emitting display device including: a data driver for supplying data signals to output lines; a connecting unit for selectively coupling a data line of data lines to a corresponding one of output lines or an initial power supply, and being positioned between the output lines and the data lines; a second power supply for applying second power having low level and high level to pixels positioned at crossing regions of the scan lines and the data lines; and a first control line coupled to the pixels, in which each of the pixels includes an organic light emitting diode, and an anode electrode of the organic light emitting diode is supplied with the voltage of the initial power supply for the initializing period.

The initial power supply is configured to supply a voltage lower than the data signals. The second power supply is configured to supply a voltage of the high level for the initializing period and the scan period, and a voltage of the low level for the emission period.

Each of the pixels includes an organic light emitting diode having a cathode electrode coupled to the second power supply; a first transistor having a second electrode coupled to an anode electrode of the organic light emitting diode, and a first electrode coupled to the data line; a second transistor coupled between a gate electrode and the second electrode of the first transistor, and being configured to turn on when a scan signal is supplied to a corresponding scan line of the scan lines; a storage capacitor coupled between the gate electrode of the first transistor and a first power supply; and a third transistor coupled between the first power supply and the first electrode of the first transistor, and being configured to turn on when a first control signal is supplied to the first control line. The pixel further includes a fourth transistor coupled between the second electrode of the first transistor and the organic light emitting diode, a gate electrode of the fourth transistor being coupled to a second control line, and the fourth transistor is configured to turn on when a second control signal is supplied to the second control line. The pixel further includes a fifth transistor coupled between the data line and the anode electrode of the organic light emitting diode, a gate electrode of the fifth transistor being coupled to a third control line, and the fifth transistor is configured to turn on when a third control signal is supplied to a third control line.

According to the pixel and the organic light emitting display device of the present invention using the same, the threshold voltage of the driving transistor could be compensated for while minimizing or reducing the number of the transistors included in the pixels.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
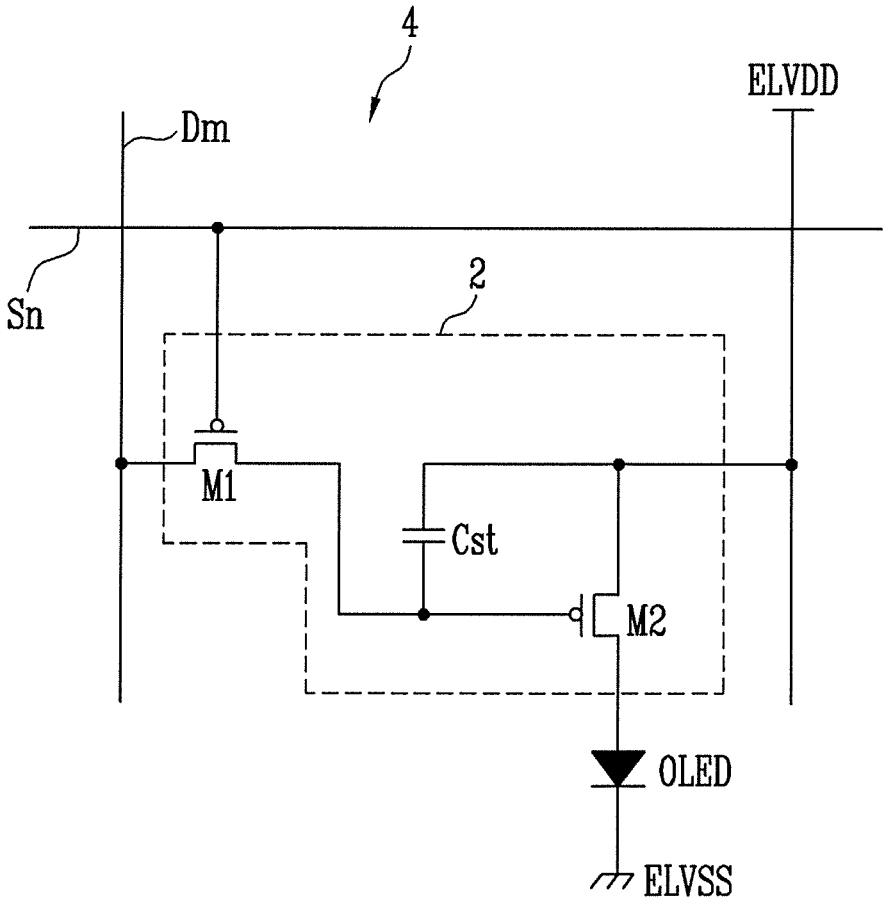
FIG. 1 is a circuit diagram showing a pixel of an organic light emitting display device according to the related art.

Hereinafter, certain exemplary embodiments according to the present invention will be described with reference to the accompanying drawings. Here, when a first element is described as being coupled to a second element, the first element may be directly coupled to the second element or may be indirectly coupled to the second element through one or more third elements. Further, some of the elements that are not essential to the complete understanding of the invention are omitted for clarity. Also, like reference numerals refer to like elements throughout.

Exemplary embodiments for those skilled in the art to implement the present invention are described hereafter in detail with reference to FIGS. 2 to 10.

Figure 2:
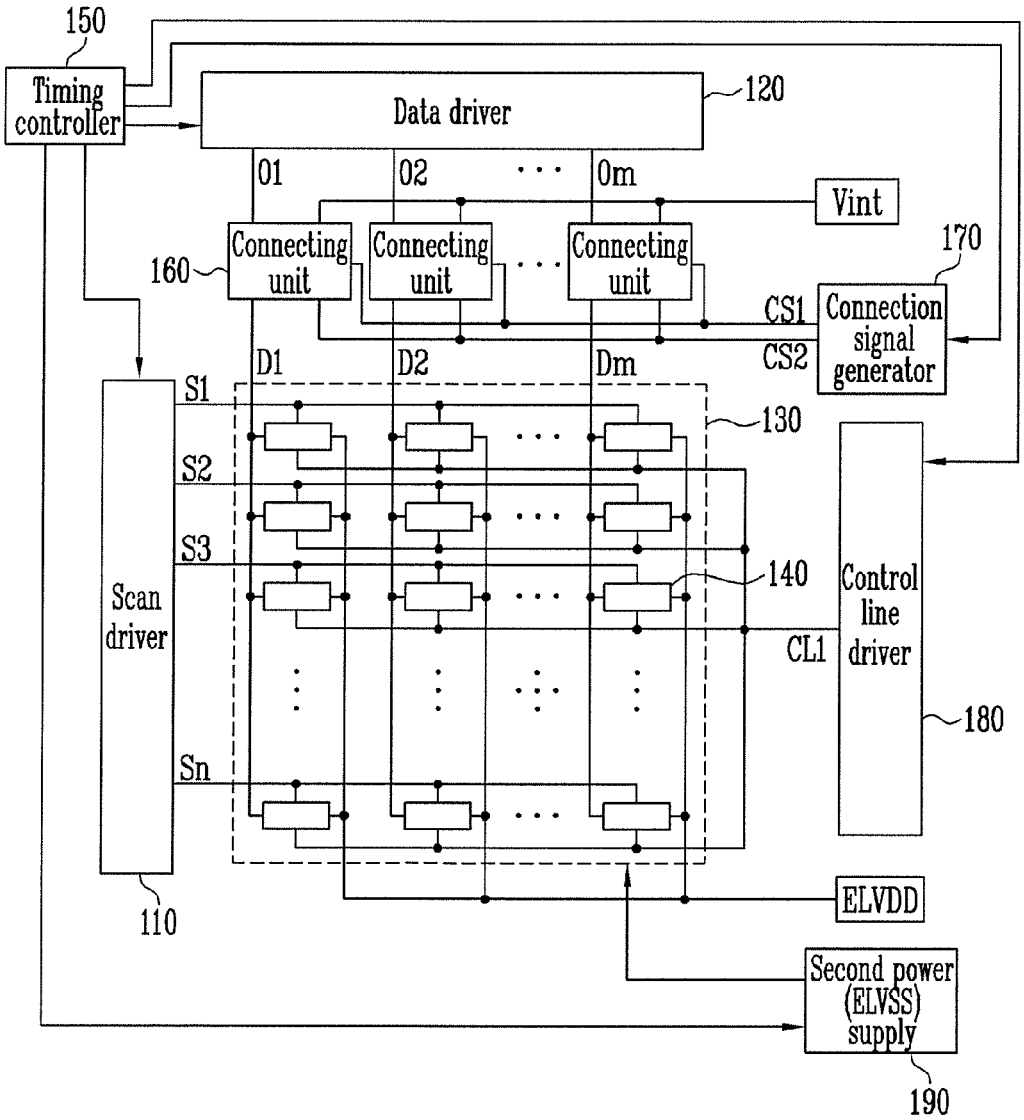
FIG. 2 is a diagram showing an organic light emitting display device according to an embodiment of the present invention.

FIG. 2 is a drawing showing an organic light emitting display device according to an embodiment of the present invention.

Referring to FIG. 2, an organic light emitting display device according to an embodiment of the present invention includes a pixel unit 130 including pixels 140 coupled to the scan lines S1 to Sn and the data lines D1 to Dm, a scan driver 110 for supplying a scan signal to the scan lines S1 to Sn, and a data driver 120 for supplying a data signal to the output lines O1 to Om.

In addition, an organic light emitting display device according to an embodiment of the present invention includes connecting units 160 that are formed between the output lines O1 to Om and the data lines D1 to Dm, a connection signal generator 170 for supplying connecting signals to the connecting units 160, a control line driver 180 for supplying a control signal to a first control line CL1, a second power supply 190 for supplying a second power ELVSS to the pixels 140, the scan driver 110, the data driver 120, and a timing controller 150 for controlling the connection signal generator 170 and the second power supply 190.

The scan driver 110 supplies the scan signal to the scan lines S1 to Sn. In this configuration, the scan driver 110 concurrently (e.g., simultaneously) or sequentially supplies the scan signal to the scan lines S1 to Sn for one frame period.

The data driver 120 supplies the data signal to the output lines O1 to Om such that it is synchronized with the scan signal sequentially supplied to the scan lines S1 to Sn.

The second power supply 190 supplies the second power ELVSS to the pixels 140. In this configuration, the second power supply 190 supplies the second power ELVSS that has a high level and a low level for each frame period. The high-level second power ELVSS is set to the voltage that the current is not able to flow from the pixel 140 (i.e., a voltage higher than the data signal), and the low-level second power ELVSS is set to the voltage that the current is able to flow from the pixel 140 (i.e., a voltage lower than the data signal).

The connection signal generator 170 generates the first connecting signal CS1 and the second connecting signal CS2 and supplies them to the connecting units 160.

The control line driver 180 supplies the first control signal to the first control line CL1 that is coupled in common with the pixels 140.

A connecting unit 160 is formed for every output lines O1 to Om, and is coupled with one of the data lines D1 to Dm. The connecting units 160 selectively connect the data lines D1 to Dm to the output lines O1 to Om or an initial power supply Vint in accordance with the first connecting signal CS1 and the second connecting signal CS2. In this configuration, the initial power supply Vint is a power supply for initializing the driving transistor included in the pixel 140, and is set to a voltage lower than the data signal.

The pixel unit 130 includes the pixels 140 that are positioned at the crossing regions between the scan lines S1 to Sn and the data lines D1 to Dm. The pixels 140 are supplied with the first power ELVDD and the second power ELVSS. The pixel 140 controls the amount of current supplied from the first power supply ELVDD to the second power supply ELVSS through the organic light emitting diode corresponding to the data signal for an emission period in one frame period. Then, light having predetermined luminance is generated by the organic light emitting diode.

Figure 3:
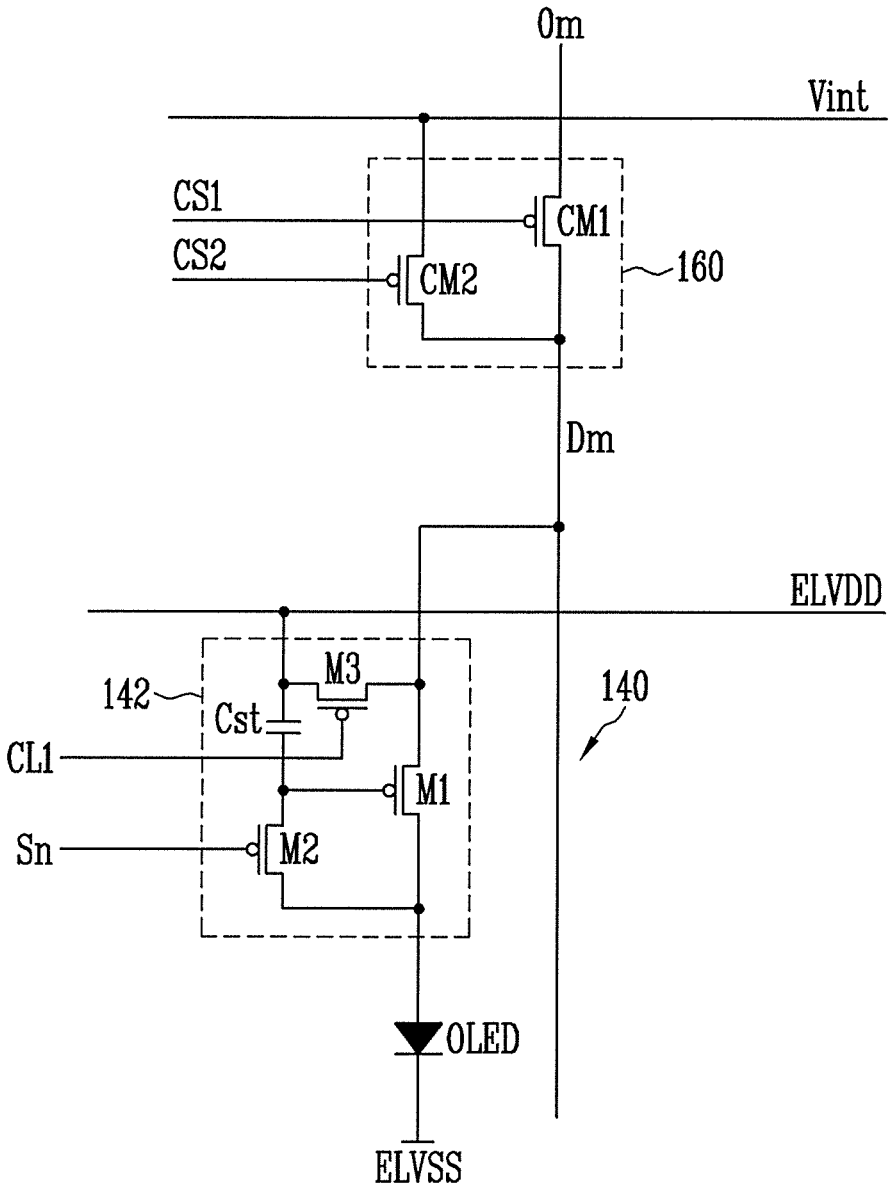
FIG. 3 is a circuit diagram showing a connecting unit and a pixel according to a first embodiment of the present invention.

FIG. 3 is a circuit diagram showing the connecting unit 160 and the pixel 140 according to the first embodiment of the present invention. In FIG. 3, for the convenience of description, the connecting unit 160 coupled to the m-th output line Om and the pixel 140 coupled to the n-th scan line Sn are shown.

Referring to FIG. 3, the connecting unit 160 according to the first embodiment of the present invention includes a first control transistor CM1 and a second control transistor CM2.

The first control transistor CM1 is formed between the output line Om and the data line Dm. The first control transistor CM1 is turned on when the first connecting signal CS1 is supplied.

The second control transistor CM2 is formed between the data line Dm and the initial power supply Vint. The second control transistor CM2 is turned on when the second connecting signal CS2 is supplied.

The pixel 140 according to an embodiment of the present invention includes the organic light emitting diode OLED and a pixel circuit 142 for controlling the amount of current that is supplied to the organic light emitting diode OLED.

An anode electrode of the organic light emitting diode OLED is coupled to the pixel circuit 142, and a cathode electrode is coupled to the second power supply ELVSS. The organic light emitting diode OLED generates light having predetermined luminance corresponding to the current that is supplied from the pixel circuit 142.

The pixel circuit 142 is charged at a voltage corresponding to the threshold voltage of its driving transistor and a data signal, and controls the amount of current that is supplied to the organic light emitting diode OLED corresponding to the charged voltage. In FIG. 3, the pixel circuit 142 includes first to third transistors M1 to M3 and a storage capacitor Cst.

The first electrode of the first transistor M1 is coupled to the data line Dm, and the second electrode of the first transistor M1 is coupled to the anode electrode of the organic light emitting diode OLED. In addition, the gate electrode of the first transistor M1 is coupled to the first terminal of the storage capacitor Cst. The first transistor M1 controls the amount of current that is supplied to the organic light emitting diode OLED corresponding to the voltage charged in the storage capacitor Cst.

The first electrode of the second transistor M2 is coupled to the second electrode of the first transistor M1, and the second electrode of the second transistor M2 is coupled to the first terminal of the first capacitor Cst. In addition, the gate electrode of the second transistor M2 is coupled to the scan line Sn. The second transistor M2 is turned on when the scan signal is supplied to the scan line Sn to connect the first transistor M1 in the form of diode.

A third transistor M3 is coupled between the second terminal of the storage capacitor Cst and the first electrode of the first transistor M1. In addition, the gate electrode of the third transistor M3 is coupled to the first control line CL1. The third transistor M3 is turned on when the first control signal is supplied from the control line driver 180.

The storage capacitor Cst is coupled between the gate electrode of the first transistor M1 and the first power supply ELVDD. The storage capacitor Cst is charged at a voltage corresponding to the threshold voltage of the first transistor M1 and the data signal.

Figure 4:
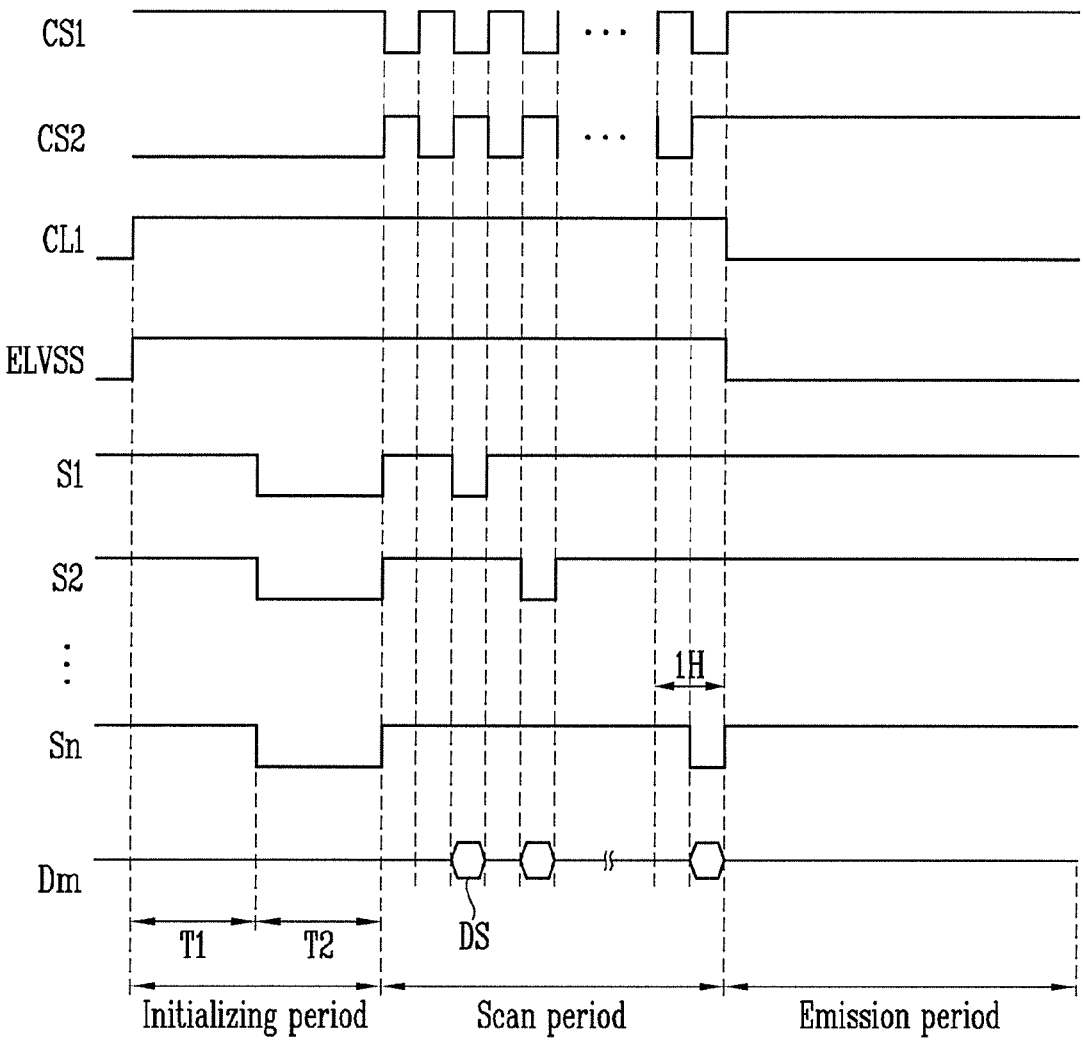
FIG. 4 is a waveform diagram showing a method for driving the connecting unit and the pixel shown in FIG. 3.

FIG. 4 is a waveform diagram showing a method for driving the connecting unit 160 and the pixel 140 shown in FIG. 3.

Referring to FIG. 4, one frame period according to the present invention is divided into an initializing period, a scan period and an emission period for driving the pixel 140.

The initializing period is divided into a first period T1 and a second period T2. For the first period T1, the anode electrode voltage of the organic light emitting diode OLED is initialized, and for the second period T2, the gate electrode of the first transistor M1 is initialized.

For the scan period, the voltage corresponding to the data signal and the threshold voltage of the first transistor M1 is charged in the storage capacitor Cst of each of the pixels 140. Because the second power supply ELVSS is set to the high level for the initializing period and the scan period, the pixels 140 are not light emitting.

For the emission period, each of the pixels 140 controls the amount of current that is supplied to the organic light emitting diode OLED corresponding to the voltage charged at the storage capacitor Cst.

Referring to FIGS. 3 and 4 for more detail on the operating process, for the initializing period and the scan period, the second power supply ELVSS is set to the high level. In addition, the second connecting signal CS2 is supplied for the initializing period, and the second control transistor CM2 is turned on. If the second control transistor CM2 is turned on, power of the initial power supply Vint is supplied to the data line Dm. At this time, the anode electrode voltage of the organic light emitting diode OLED is set to a voltage higher than the voltage of the data line Dm because the second power supply ELVSS is set to the high level. Accordingly, the voltage of the anode electrode of the organic light emitting diode OLED is dropped to approximately the voltage of the initial power supply Vint.

For the second period T2 in the initializing period, the scan signal is supplied to the scan lines S1 to Sn. If the scan signal is supplied to the scan lines S1 to Sn, the second transistors M2 included in the pixels 140 are turned on. If the second transistor M2 is turned on, the gate electrode of the first transistor M1 is electrically coupled to the anode electrode of the organic light emitting diode OLED. At this time, the voltage of the gate electrode of the first transistor M1 is dropped to the voltage of the anode electrode of the organic light emitting diode OLED.

Discussing in more detail, the voltage applied to the anode electrode for the first period is stored in a parasitic capacitor of the organic light emitting diode OLED. In this configuration, the parasitic capacitor of the organic light emitting diode OLED is formed such that it has a higher capacitance than the storage capacitor Cst. Accordingly, if the gate electrode of the first transistor M1 is electrically coupled to the anode electrode of the organic light emitting diode OLED for the second period T2, the voltage of the gate electrode of the first transistor M1 is dropped to approximately the voltage of the anode electrode of the organic light emitting diode OLED.

For the scan period, the scan signal is sequentially supplied to the scan lines S1 to Sn. In this configuration, a horizontal period (1H) that the scan signal can be supplied, is divided into a first half period (i.e., ½H period) and a second half period (i.e., ½H period), and the scan signal is sequentially supplied for the second half period. In addition, the first connecting signal CS1 is supplied in the second half period of the horizontal period (1H), and the second connecting signal CS2 is supplied in the first half period of the horizontal period (1H) such that they are synchronized with the scan signal.

The second control transistor CM2 is turned on by being supplied with the second connecting signal CS2 for the first half period prior to supplying the scan signal to the n-th scan line Sn. If the second control transistor CM2 is turned on, power of the initial power supply Vint is supplied to the data line Dm. At this time, the voltage of the anode electrode of the organic light emitting diode OLED is dropped to approximately the voltage of the initial power supply Vint. For the first half period of the horizontal period (1H), the voltage of the anode electrode of the organic light emitting diode OLED, which is increased by the previous data signal, is dropped.

Describing in more detail, when the scan signal is sequentially supplied to the scan lines S1 to Sn, the data signal is supplied to the data lines D1 to Dm. In this configuration, the data signal supplied to the data lines D1 to Dm is supplied to the pixels 140 coupled to the data lines D1 to Dm, each of which is coupled to a vertical line of the pixels 140. For instance, the data signal that is supplied to the m-th data line Dm such that it is synchronized with the scan signal supplied to the first scan line S1, is also supplied to the pixel connected to the n-th scan line Sn and the m-th data line Dm. In this case, the anode electrode of the pixel 140 coupled to the n-th scan line Sn and the m-th data line Dm is supplied with the undesired data signal. According to an embodiment of the present invention, the horizontal period (1H) initializes the voltage of the anode electrode of the organic light emitting diode OLED for the first half period such that the desired voltage is stably charged in the storage capacitor Cst.

After the voltage of the anode electrode of the organic light emitting diode OLED is initialized, the scan signal is supplied to the n-th scan line Sn to turn-on the second transistor M2. In addition, for the second half period, the first control transistor CM1 is turned on to electrically couple the output line Om with the data line Dm.

If the second transistor M2 is turned on, the first transistor M1 is connected in the form of diode. If the first control transistor CM1 is turned on, the data signal is supplied to the data line Dm. At this time, the first transistor M1 is turned on because the voltage of the gate electrode of the first transistor M1 is set to a voltage lower than the data signal. If the first transistor M1 is turned on, the voltage corresponding to the threshold voltage of the first transistor M1 and the data signal is applied to the gate electrode of the first transistor M1. At this time, the storage capacitor Cst is charged at a voltage corresponding to the threshold voltage of the first transistor M1 and the data signal.

For the emission period, the first control signal is supplied to the first control line CL1. If the first control signal is supplied, the third transistor M3 included in the pixel 140 is turned on. If the third transistor M3 is turned on, the voltage of the first power supply ELVDD is supplied to the data line Dm. At this time, the first transistor M1 generates light while controlling the amount of current flowing from the first power supply ELVDD to the second power supply ELVSS through the organic light emitting diode OLED corresponding to the voltage charged at the storage capacitor Cst.

Figure 5:
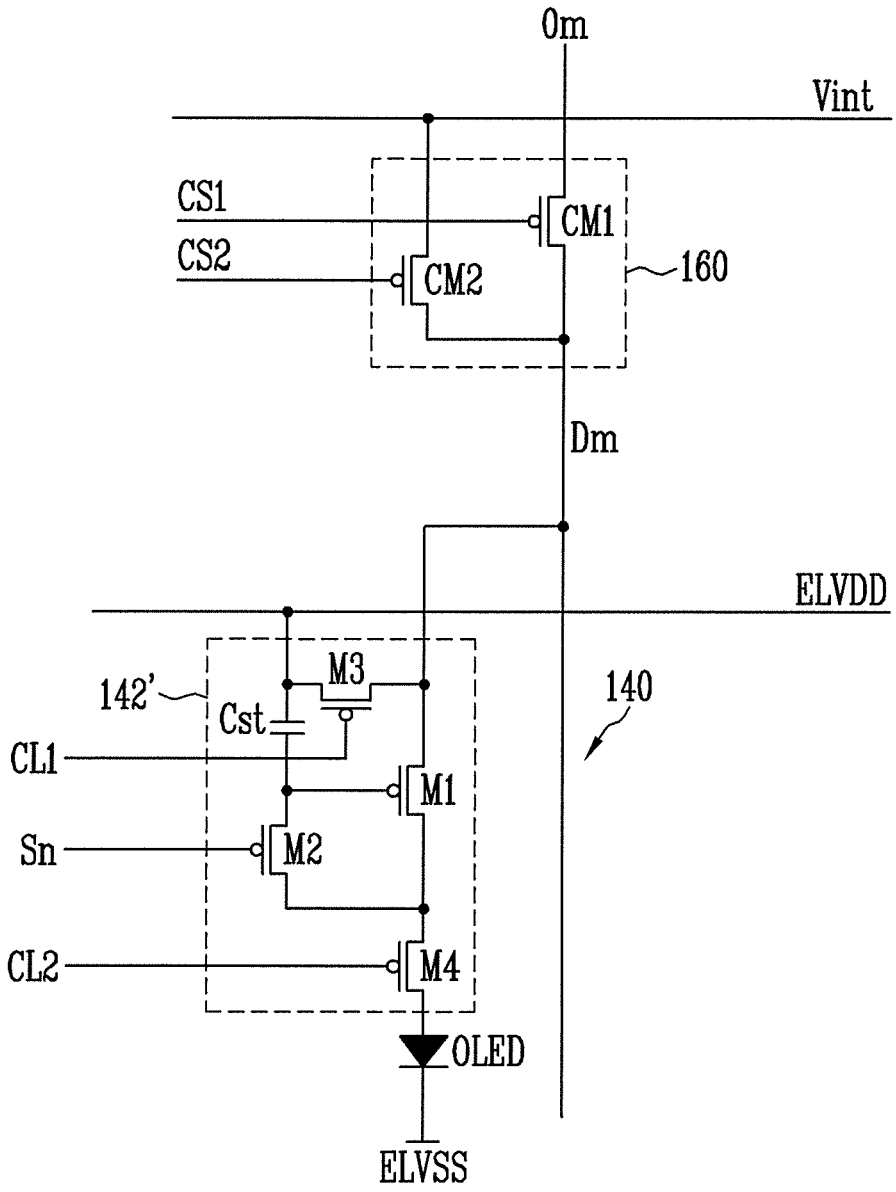
FIG. 5 is a circuit diagram showing a connecting unit and a pixel according to a second embodiment of the present invention.

FIG. 5 is a circuit diagram showing a connecting unit 160 and a pixel 140 according to the second embodiment of the present invention. For convenience, when describing FIG. 5, the same components as described in FIG. 3 are referred to by the same reference numerals, and their detail descriptions will not be provided.

Referring to FIG. 5, the pixel 140 according to the second embodiment of the present invention includes an organic light emitting diode OLED and a pixel circuit 142' that controls the amount of current supplied to the organic light emitting diode OLED.

An anode electrode of the organic light emitting diode OLED is coupled to the pixel circuit 142', and a cathode electrode is coupled to the second power supply ELVSS. The organic light emitting diode OLED generates light having predetermined luminance corresponding to the current supplied from the pixel circuit 142'.

The pixel circuit 142' is charged at a voltage corresponding to the threshold voltage of the driving transistor and the data signal, and controls the amount of current supplied to the organic light emitting diode OLED corresponding to the charged voltage. In FIG. 5, the pixel circuit 140 includes first to the fourth transistors M1 to M4 and a storage capacitor Cst.

The first electrode of the fourth transistor M4 is coupled to the first electrode of the first transistor M1, and the second electrode of the fourth transistor M4 is coupled to the anode electrode of the organic light emitting diode OLED. In addition, the gate electrode of the fourth transistor M4 is coupled to a second control line CL2. The fourth transistor M4 is turned on when a second control signal is supplied to the second control line CL2. Here, the second control line CL2 is coupled to all the pixels 140 in common, and is supplied with the second control signal from the control line driver 180 for the initializing period and the emission period.

Figure 6:
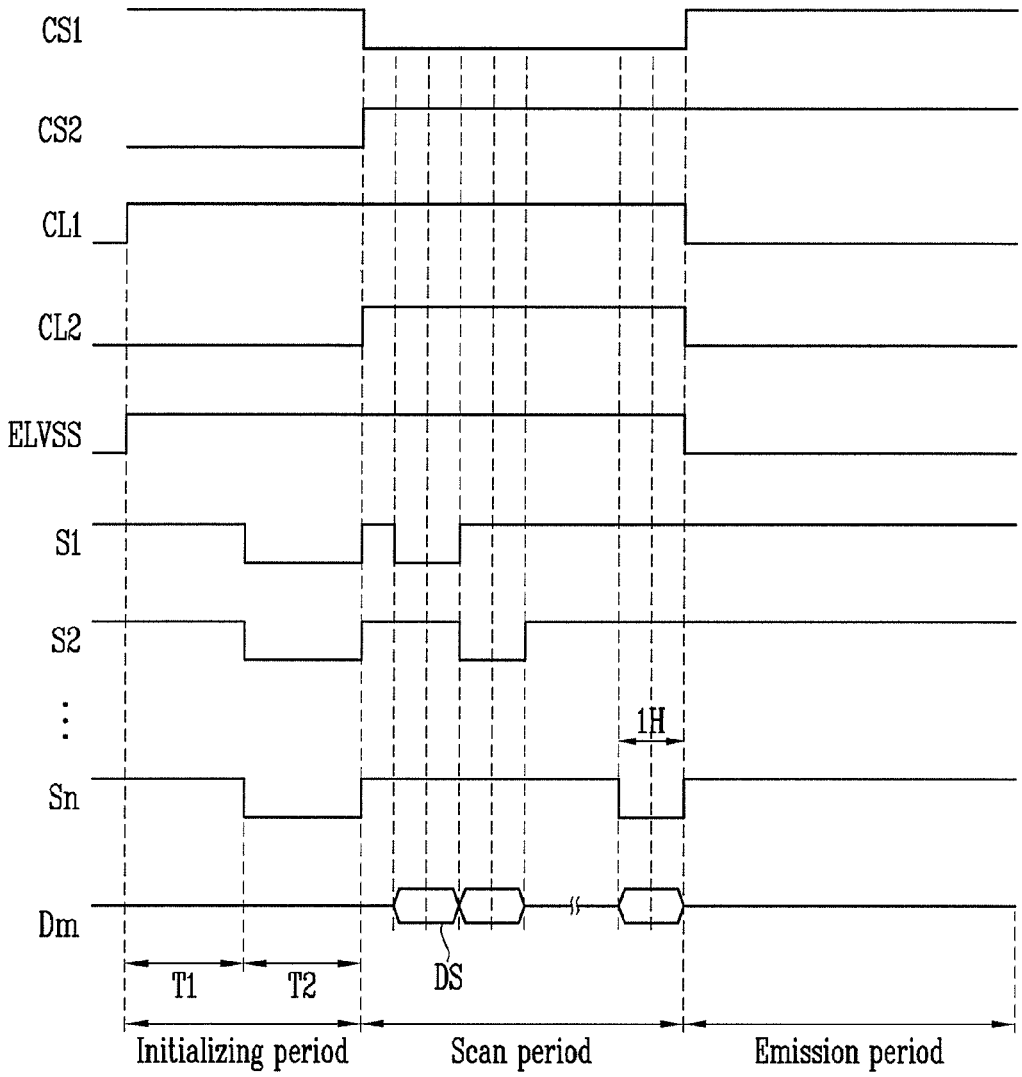
FIG. 6 is a waveform diagram showing a method for driving the connecting unit and the pixel shown in FIG. 5.

FIG. 6 is a waveform diagram showing a method for driving the connecting unit 160 and the pixel 140 shown in FIG. 5.

Referring to FIG. 6, the first connecting signal CS1 is supplied for the scan period, and the second connecting signal CS2 is supplied for the initializing period. In addition, the second control signal is supplied to the second control line CL2 for the initializing period and the emission period.

The second control transistor CM2 is turned on for the first period T1 in the initializing period. If the second control transistor CM2 is turned on, power of the initial power supply Vint is supplied to the data line Dm. At this time, the voltage of the anode electrode of the organic light emitting diode OLED is set to a voltage higher than the initial power supply Vint because the second power supply ELVSS is set to the high level, thus the voltage of the anode electrode of the organic light emitting diode OLED is dropped to approximately the voltage of the initial power supply Vint.

For the second period T2 in the initializing period, the scan signal is supplied to the scan lines S1 to Sn. If the scan signal is supplied to the scan lines S1 to Sn, the second transistor M2 included in each of the pixels 140 is turned on. If the second transistor M2 is turned on, the gate electrode of the first transistor M1 is electrically coupled to the anode electrode of the organic light emitting diode OLED. At this time, the voltage of the gate electrode of the first transistor M1 is dropped to the voltage of the anode electrode of the organic light emitting diode OLED.

For the scan period, the supply of the second control signal to the second control line CL2 is stopped. If the supply of the second control signal is stopped, the fourth transistor M4 is set to the turn-off condition. Accordingly, the anode electrode of the organic light emitting diode OLED keeps the voltage of the initial power supply Vint supplied for the initializing period for the scan period.

In addition, the scan signal is sequentially supplied to the scan lines S1 to Sn for the scan period. In this configuration, the scan signal is supplied for the horizontal period of 1H because the anode electrode of the organic light emitting diode OLED keeps the voltage of the initial power supply Vint.

If the scan signal is supplied to the n-th scan line Sn, the second transistor M2 is turned on. If the second transistor M2 is turned on, the first transistor M1 is connected in the diode form. Here, the data signal DS is supplied to the data line Dm such that it is synchronized to the scan signal supplied to the n-th scan line Sn. At this time, the gate electrode of the second transistor M2 is set to a voltage lower than the data signal DS by the supplied voltage for the initializing period, thus the first transistor M1 is turned on. If the first transistor M1 is turned on, the voltage corresponding to the threshold voltage of the first transistor M1 and the data signal DS is applied to the gate electrode of the first transistor M1. At this time, the storage capacitor Cst is charged at a voltage corresponding to the threshold voltage of the first transistor M1 and the data signal DS.

For the emission period, the first control signal is supplied to the first control line CL1. If the first control signal is supplied, the third transistor M3 included in the each pixel 140 is turned on. If the third transistor M3 is turned on, the voltage of the first power supply ELVDD is supplied to the data line Dm. At this time, the first transistor M1 generates light while controlling the amount of current flowing from the first power supply ELVDD to the second power supply ELVSS through the organic light emitting diode OLED corresponding to the voltage of the charged storage capacitor Cst.

Figure 7:
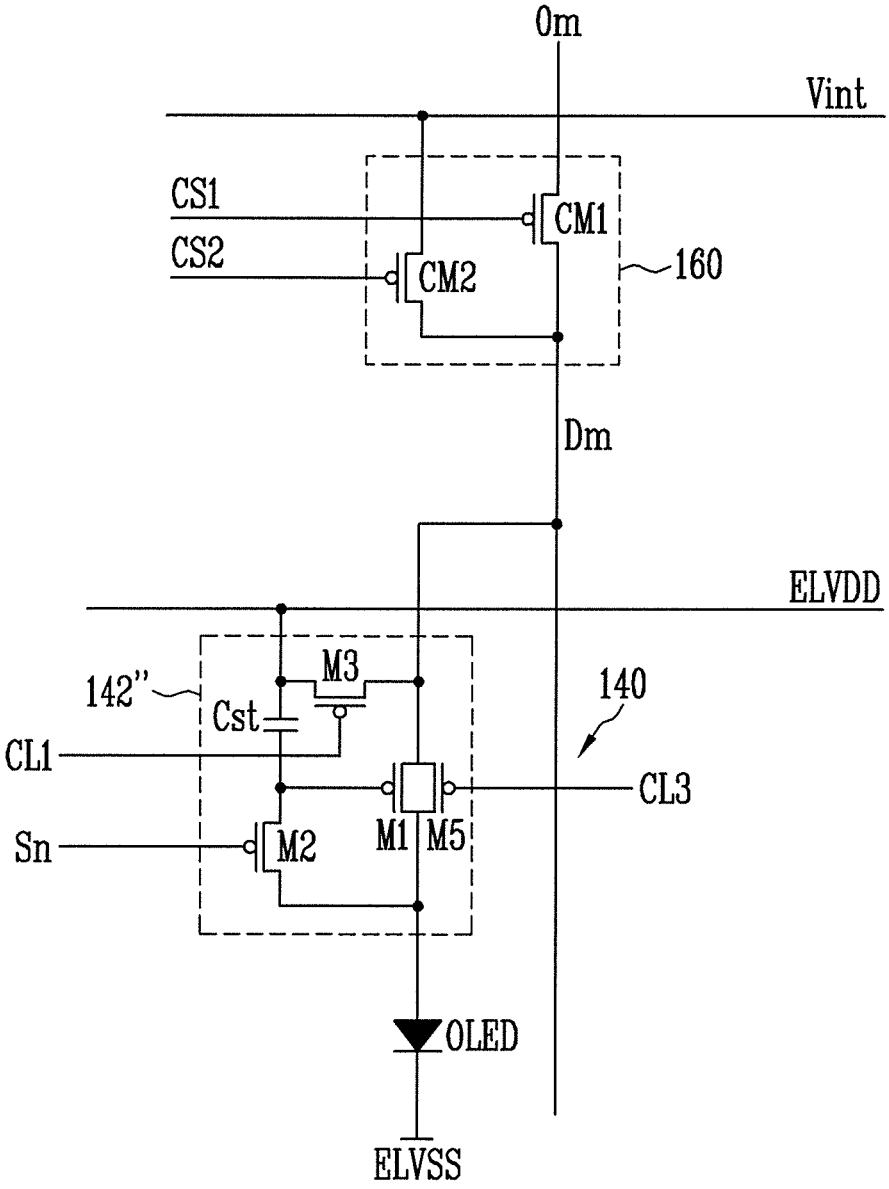
FIG. 7 is a circuit diagram showing a connecting unit and a pixel according to a third embodiment of the present invention.

FIG. 7 is a circuit diagram showing a connecting unit 160 and a pixel 140 according to the third embodiment of the present invention. For convenience, when describing FIG. 7, the same components as described in FIG. 3 are referred to by the same reference numerals, and their detail descriptions will not be provided.

Referring to FIG. 7, the pixel 140 according to the third embodiment of the present invention includes the organic light emitting diode OLED and a pixel 142" for controlling the amount of current supplied to the organic light emitting diode OLED.

The anode electrode of the organic light emitting diode OLED is coupled to the pixel circuit 142", and the cathode electrode is coupled to the second power supply ELVSS. The organic light emitting diode OLED generates light having predetermined luminance corresponding to the current supplied from the pixel circuit 142".

The pixel circuit 142" is charged at a voltage corresponding to the threshold voltage of the driving transistor and the data signal, and controls the amount of current supplied to the organic light emitting diode OLED corresponding to the charged voltage. In FIG. 7, the pixel circuit 142" includes the first transistor M1, the second transistor M2, the third transistor M3, a fifth transistor M5 and the storage capacitor Cst.

The fifth transistor M5 is coupled to the first transistor M1 in parallel. In other words, the first electrode of the fifth transistor M5 is coupled to the data line Dm, and the second electrode of the fifth transistor M5 is coupled to the anode electrode of the organic light emitting diode OLED. In addition, the gate electrode of the fifth transistor M5 is coupled to a third control line CL3. The fifth transistor M5 is turned on when a third control signal is supplied to the third control line CL3. Here, the third control line CL3 is coupled in common to all the pixels 140, and is supplied with the third control signal for the initializing period.

Figure 8:
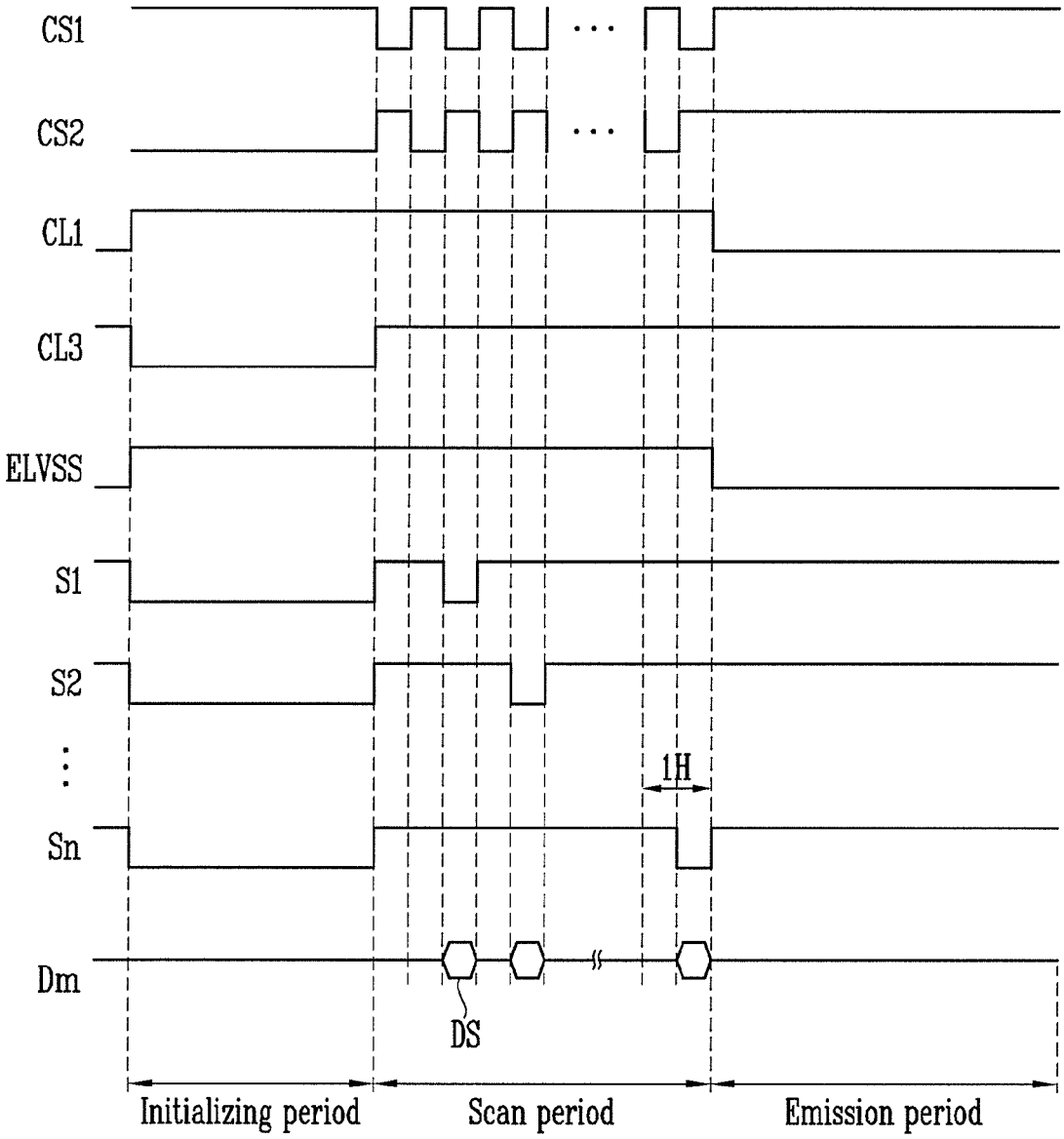
FIG. 8 is a waveform diagram showing a method for driving the connecting unit and the pixel shown in FIG. 7.
Figure 9:
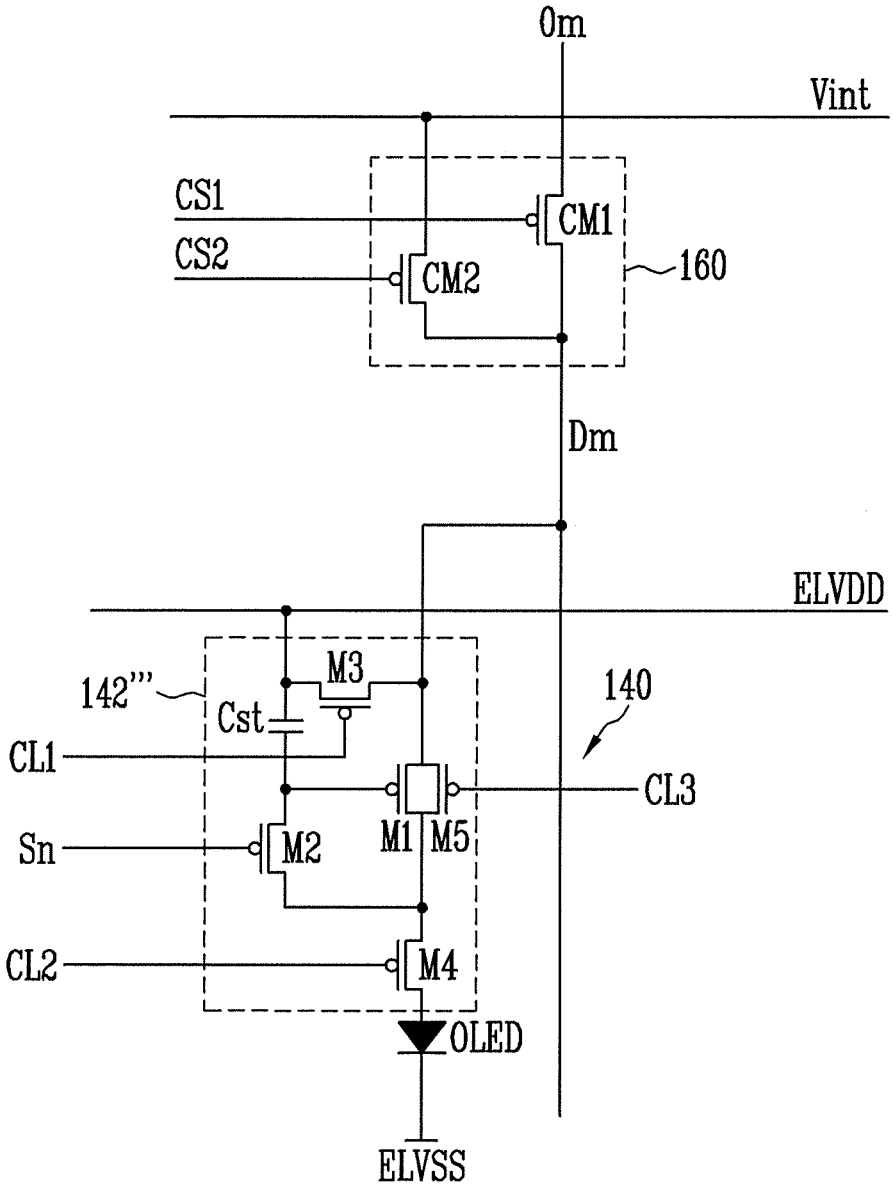
FIG. 9 is a circuit diagram showing a connecting unit and a pixel according to a fourth embodiment of the present invention.
Figure 10:
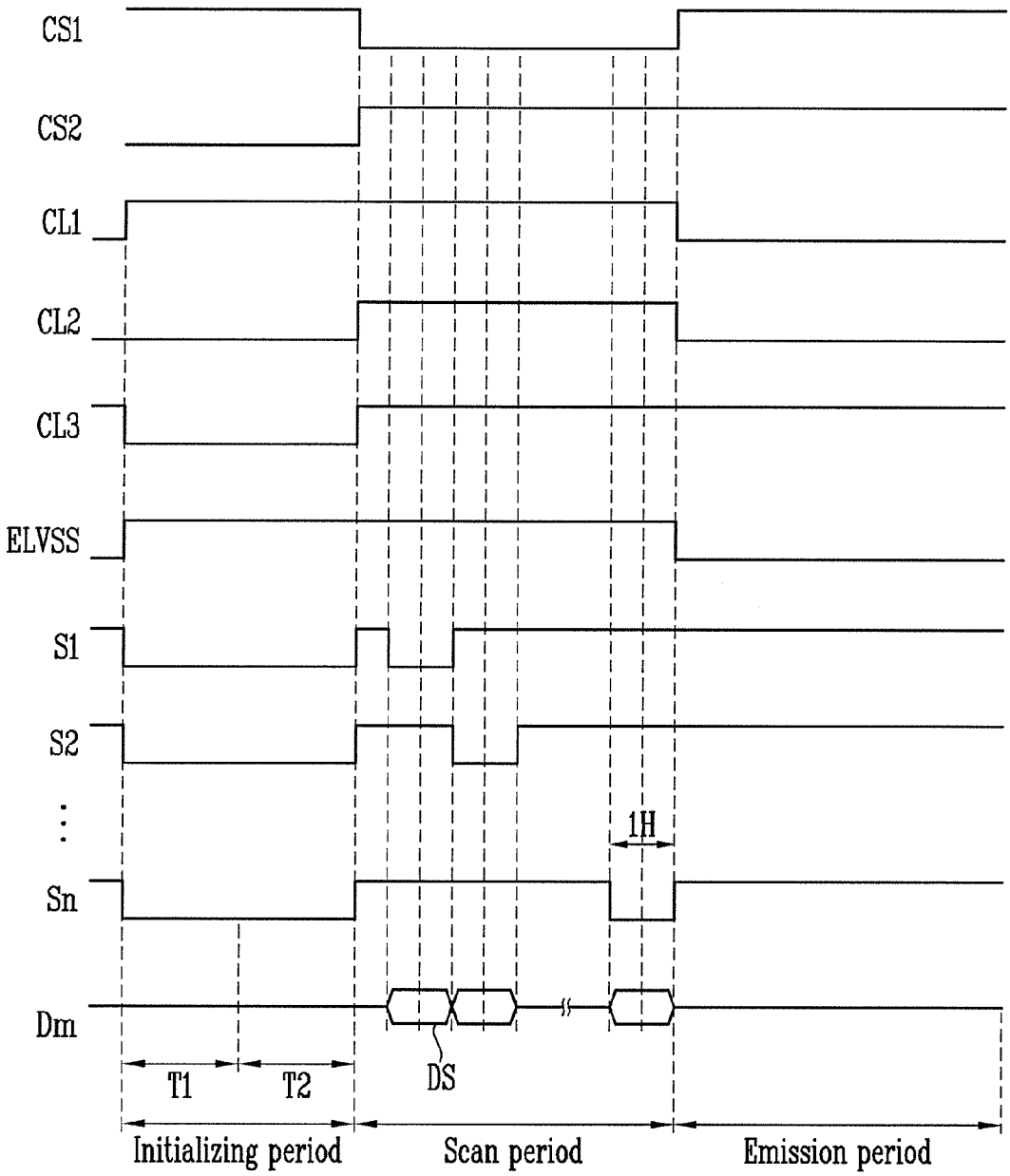
FIG. 10 is a waveform diagram showing a method for driving the connecting unit and the pixel shown in FIG. 9.

FIG. 8 is a waveform diagram showing a method for driving the connecting unit 160 and the pixel 140 shown in FIG. 7. The waveform shown in FIG. 8 is the same as the waveform shown in FIG. 4, except the initializing period.

Referring to FIG. 8, the second control transistor CM2 is turned on by the second connecting signal CS2 for the initializing period, the fifth transistor M5 is turned on by the third control signal supplied to the third control line CL3. In addition, the high-level second power ELVSS is supplied for the initializing period, at the same time, the scan signal is supplied to the scan lines S1 to Sn.

If the scan signal is supplied to the scan line Sn, the second transistor M2 is turned on. If the second transistor M2 is turned on, the gate electrode of the first transistor M1 is electrically coupled to its second electrode. If the fifth transistor M5 is turned on, the data line Dm is electrically coupled to the anode electrode of the organic light emitting diode OLED.

If the second transistor CM2 is turned on, the voltage of the initial power supply Vint is supplied to the data line Dm. At this time, the gate electrode of the first transistor M1 and the anode electrode of the organic light emitting diode OLED are supplied with the voltage of the initial power supply Vint.

For the scan period, the scan signal is sequentially supplied to the scan lines S1 to Sn, and the data signal that is synchronized to the scan signal is supplied to the data lines D1 to Dm. For the scan period, the storage capacitor Cst included in each of the pixel 140 is charged at the voltage corresponding to the data signal and the threshold voltage of the first transistor M1.

For the emission period, the first transistor M1 controls the amount of current flowing from the first power supply ELVDD to the second power supply ELVSS through the organic light emitting diode OLED corresponding to the voltage charged in the storage capacitor Cst.

Here, in the present invention, it is possible to additionally form the fourth transistor M4 between the second electrode of the first transistor M1 and the anode electrode of the organic light emitting diode OLED according to one embodiment. In this case, it is possible to supply the scan signal having the width of 1H for the scan period shown in FIG. 10.

In the operation process, the second transistor M2, the fourth transistor M4 and the fifth transistor M5 are set to the turn-on condition for the initializing period. At this time, the gate electrode of the first transistor M1 and the anode electrode of the organic light emitting diode OLED are initialized with the voltage of the initial power supply Vint supplied to the data line Dm.

For the scan period, the scan signal is sequentially supplied to the scan lines S1 to Sn, and the data signal is supplied to the data lines D1 to Dm such that it is synchronized to the scan signal. For the scan period, the storage capacitor included in each of the pixels 140 is charged at a voltage corresponding to the threshold voltage of the first transistor M1 and the data signal. Here, the anode electrode of the organic light emitting diode OLED keeps the voltage supplied for the initializing period because the fourth transistor M4 is set to the turn-off condition for the scan period.

For the emission period, the first transistor M1 controls the amount of current flowing from the first power supply ELVDD to the second power supply ELVSS through the organic light emitting diode OLED corresponding to the voltage charged in the storage capacitor Cst.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device configured to operate for an initializing period, a scan period and an emission period divided from one frame period, the organic light emitting display device comprising:

a data driver for supplying data signals to output lines;

a connecting unit for selectively coupling a data line of data lines to a corresponding one of the output lines or an initial power supply, and being positioned between the output lines and the data lines;

a second power supply for applying second power having a low level and a high level to pixels positioned at crossing regions of scan lines and the data lines; and a first control line coupled to the pixels, wherein each of the pixels comprises an organic light emitting diode, and an anode electrode of the organic light emitting diode is supplied with a voltage of the initial power supply for the initializing period, wherein the initial power supply is configured to supply a voltage lower than the data signals.

2. The organic light emitting display device as claimed in claim 1, wherein the second power supply is configured to supply a voltage of the high level for the initializing period and the scan period, and a voltage of the low level for the emission period.

3. The organic light emitting display device as claimed in claim 1, wherein each of the pixels comprises:

an organic light emitting diode having a cathode electrode coupled to the second power supply;

a first transistor having a second electrode coupled to an anode electrode of the organic light emitting diode, and a first electrode coupled to the data line;

a second transistor coupled between a gate electrode of the first transistor and the second electrode of the first transistor, and being configured to turn on when a scan signal is supplied to a corresponding scan line of the scan lines;

a storage capacitor coupled between the gate electrode of the first transistor and a first power supply; and a third transistor coupled between the first power supply and the first electrode of the first transistor, and being configured to turn on when a first control signal is supplied to the first control line.

4. The organic light emitting display device as claimed in claim 3, further comprising a control line driver for supplying the first control signal for the emission period.

5. The organic light emitting display device as claimed in claim 3, further comprising a scan driver for concurrently supplying the scan signal to the scan lines for a first period of the initializing period, and for sequentially supplying the scan signal to the scan lines for the scan period.

6. The organic light emitting display device as claimed in claim 5, wherein the scan period comprises a plurality of horizontal periods, and the scan driver is configured to sequentially supply the scan signal for a second half period of each of the horizontal periods.

7. The organic light emitting display device as claimed in claim 5, wherein the scan period comprises a plurality of horizontal periods, and the scan driver is configured to sequentially supply the scan signal for each of the horizontal periods.

8. The organic light emitting display device as claimed in claim 3, wherein the pixel further comprises a fourth transistor coupled between the second electrode of the first transistor and the organic light emitting diode, a gate electrode of the fourth transistor being coupled to a second control line, and the fourth transistor is configured to turn on when a second control signal is supplied to the second control line.

9. The organic light emitting display device as claimed in claim 8, further comprising a control line driver for supplying the second control signal for the initializing period and the emission period.

10. The organic light emitting display device as claimed in claim 3, wherein the pixel further comprises a fifth transistor coupled between the data line and the anode electrode of the organic light emitting diode, a gate electrode of the fifth transistor being coupled to a third control line, and the fifth transistor is configured to turn on when a third control signal is supplied to the third control line.

11. The organic light emitting display device as claimed in claim 10, further comprising a control line driver for supplying the third control signal for the initializing period.

12. The organic light emitting display device as claimed in claim 10, further comprising a scan driver for concurrently supplying the scan signal to the scan lines for the initializing period, and for sequentially supplying the scan signal to the scan lines for the scan period.

13. The organic light emitting display device as claimed in claim 12, wherein the scan period comprises a plurality of horizontal periods, and the scan driver is configured to sequentially supply the scan signal for a second half period of each of the horizontal periods.

14. The organic light emitting display device as claimed in claim 12, wherein the scan period comprises a plurality of horizontal periods, and the scan driver is configured to sequentially supply the scan signal for each of the horizontal periods.

15. The organic light emitting display device as claimed in claim 10, wherein the pixel further comprises a fourth transistor coupled between the second electrode of the first transistor and the organic light emitting diode, and the fourth transistor is configured to turn on for the initializing period and the emission period.

16. The organic light emitting display device as claimed in claim 1, wherein the connecting unit comprises:

a first control transistor coupled between the output line and the data line, and being configured to turn on when a first connecting signal is supplied; and a second control transistor coupled between the initial power supply and the data line, and being configured to turn on when a second connecting signal is supplied.

17. The organic light emitting display device as claimed in claim 16, further comprising a connection signal generator for supplying a second control signal for the initializing period.

18. The organic light emitting display device as claimed in claim 17, wherein the scan period comprises a plurality of horizontal periods, and the connection signal generator is configured to supply the second control signal for a first half period of each of the horizontal periods and to supply the first control signal for a second half period of each of the horizontal periods except the first half period.

19. The organic light emitting display device as claimed in claimed 17, wherein the connection signal generator is configured to supply the first control signal for the scan period.

* * * * *